US007872199B2

(12) United States Patent
Karlsen et al.

(10) Patent No.: US 7,872,199 B2
(45) Date of Patent: Jan. 18, 2011

(54) ELECTRICAL CABLE

(75) Inventors: Stian Karlsen, Halden (NO); Sjur Kristion Lund, Halden (NO)

(73) Assignee: Nexans, Paris (FR)

( * ) Notice: Subject to any disclaimer, the term of this patent is extended or adjusted under 35 U.S.C. 154(b) by 68 days.

(21) Appl. No.: 12/288,168

(22) Filed: Oct. 16, 2008

(65) Prior Publication Data

US 2009/0120663 A1 May 14, 2009

(30) Foreign Application Priority Data

Oct. 17, 2007 (NO) ..... 20075300

(51) Int. Cl.
*H01B 11/02* (2006.01)

(52) U.S. Cl. ..... 174/120 R

(58) Field of Classification Search ..... 174/120 R, 174/120 SR, 113 R

See application file for complete search history.

(56) References Cited

U.S. PATENT DOCUMENTS

| | | | | |
|---|---|---|---|---|
| 4,945,191 | A * | 7/1990 | Satsuka et al. | 174/69 |
| 5,195,158 | A | 3/1993 | Bottoms et al. | 385/105 |
| 6,424,768 | B1 | 7/2002 | Booth et al. | 385/102 |

FOREIGN PATENT DOCUMENTS

| | | |
|---|---|---|
| NO | 20050753 | 8/2006 |

* cited by examiner

*Primary Examiner*—Chau N Nguyen
(74) *Attorney, Agent, or Firm*—Sofer & Haroun, LLP

(57) ABSTRACT

Electric cable having at least one conductor (1) with an insulating layer (2) applied thereto and being twisted around a longitudinal axis of the cable, where the insulated conductor (1, 2) is provided with an enclosing elastomer layer (3) of a material having a hardness being substantially lower than the hardness of the insulating layer (2).

5 Claims, 1 Drawing Sheet

ELECTRICAL CABLE

RELATED APPLICATION

This application claims the benefit of priority from Norwegian Patent Application No. 2007 5300, filed on Oct. 17, 2007, the entirety of which is incorporated herein by reference.

FIELD OF THE INVENTION

This invention in general relates to an electric cable comprising at least one conductor with an insulating layer applied thereto and being twisted around a longitudinal axis of the cable.

BACKGROUND

Traditionally, the conductor or conductors in electric cables are made of copper, which may be subjected to various unfavourable influences depending on practical conditions during handling, installation and operation of the cables. Copper conductor cables may in particular be subjected to damage when exposed to elongation above a critical limit. For example, multifunction subsea cables, sea cables and the like are often incorporating signal and/or power cables stranded together with load carrying elements such as steel tubes. Friction forces between the load carrying elements and the copper conductors in signal or power cables cause elongation of the copper in such cables. Thus, when the electric cable is exposed to heavy loads, such as when being deployed at deep sea, the copper conductors may break due to the elongation of the load carrying elements running beside the signal/power cable components. Moreover, an insulation system or insulating layers outside the conductors will be exposed to radial loads, which may lead to so much deformation that insulation failure may be caused.

In connection with problems of the above type, it is well known to armour copper cables with high elongation modulus elements, such as steel wires or composites of synthetic fibres. Such elements prevent the copper conductor material from elongating above the critical limit when exposed to heavy loads, by causing the cable to become a load carrying element itself. This known solution will, however, usually require an unacceptable amount of armouring of the cables in order to withstand the elongation caused by large and heavy cable components, such as steel tubes in specific types of subsea cables, for example the so-called umbilicals.

In addition to the more or less traditional armouring method discussed above, there are other proposals being of some interest in connection with the present invention:

Thus, Norwegian patent application No. 20050753 relates to an electric signal cable comprising at least two insulating conductors, each of the conductors being arranged in a groove in an elongate, central element consisting of an elastic material that makes it possible for the insulated conductors to move in a radial direction when the cable is subjected to longitudinal tension loads.

U.S. Pat. No. 6,424,768 relates to electric cables, in particular ocean bottom cables, with electrical conductors or optical fibres arranged in so-called quads being helically wound around a core. However, this cable structure does not make possible any radially inwards displacement of the conductors when subjected to tension.

International patent publication WO 9214175 describes the incorporation of optical fibres in overhead transmission line groundwires. Although this is quite a remote field of technology from what is of interest to the present invention, there may be a somewhat similar problem: To avoid tensional stress in the fibres. Pliable material in a jacket protects the optical fibres from axial tension by radial flexing of the fibres. A spring-like twisting/untwisting effect is described.

OBJECTS AND SUMMARY

Thus, it is a main purpose of the present invention to provide an improved structure of electric cables for avoiding damage to copper conductors therein while making possible manufacturing of the cables by employing more or less traditional and well-proven methods.

According to the invention, in an electric cable comprising at least one conductor with an insulating layer applied thereto and being twisted around a longitudinal axis of the cable, the novel and specific features primarily consist in providing the insulated conductor with an enclosing elastomer layer of a material having a hardness being substantially lower than the hardness of the insulating layer.

The favourable effect of the elastomer layer enclosing each or some of the insulated conductors, is due to deformation of the elastomer material when the cable is subjected to tensional forces longitudinally. As will be explained more in detail below, this deformation involves reduction of the twisting pitch angle (or in other words, increase of the lay length) thus leaving the insulation system and the copper conductors intact without any critical elongation.

BRIEF DESCRIPTION OF THE DRAWINGS

In the following description referring to the drawings, an exemplary embodiment of the invention will be explained more closely.

DETAILED DESCRIPTION

Figure 1:
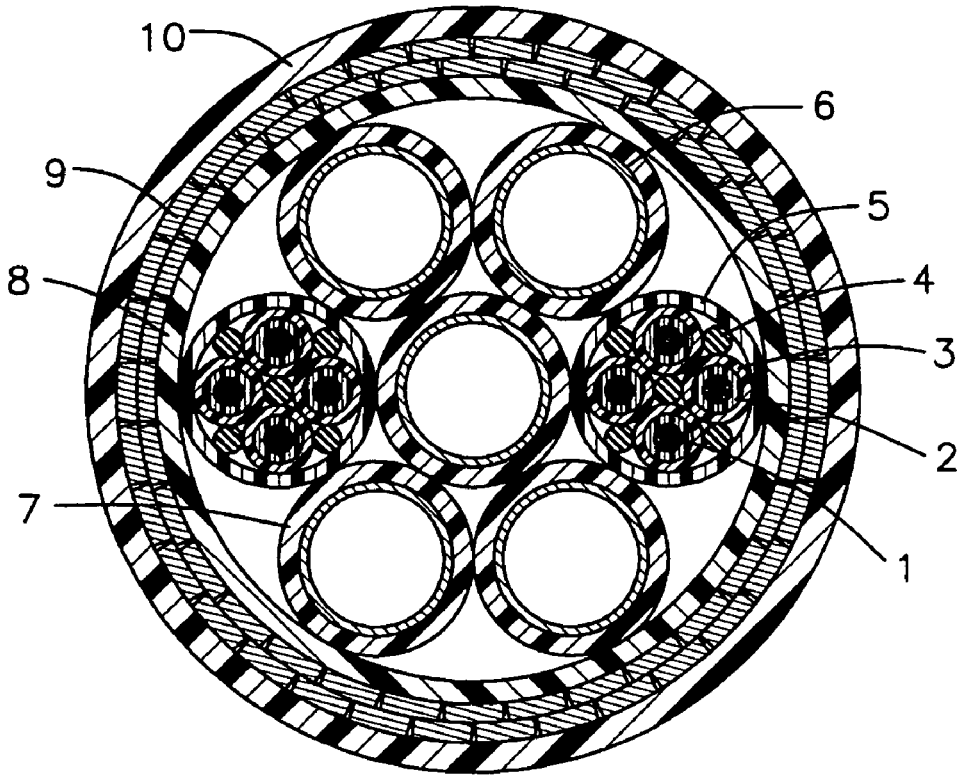
FIG. 1 shows a cross-section of a somewhat complex cable design (umbilical) comprising electric cable components having a structure according to the present invention, FIG. 2 in cross-sectional view shows one cable component that may be incorporated in the design of FIG. 1, in a condition without any appreciable axial tension applied.

The complex cable or umbilical shown in FIG. 1 comprises a number of components enclosed within an outer sheath 10 and flat armour wires 9 as well as an inner sheath 8. The components are twisted together. Some components 6 are steel tubes each having their own sheath 7, and one specific electric cable component 1-5 being of particular interest in the present context. This electric cable comprises electrical conductors 1 each with an insulation system or layer 2, here forming an electrical quad, i.e. four insulated conductors 1, 2 within a common sheath 5 and intended to normally cooperate electrically.

As shown, there is a layer 3 of an elatomer material applied outside each insulated electrical conductor 1, 2, whereby both the insulating layer 2 and the elastomer layer 3 may be layers extruded by well known methods. In view of the usual environment within such a complex cable, it is highly advantageous that the elastomer material in layer 3 is resistant to oil and petroleum jelly, such as vaseline. Morover, and more important is the requirement that the hardness of the elastomer material in layer 3 is substantially lower than the hardness of the insulating layer 2.

For filling the cross-sectional space within the common sheath 5, there are also included bolts 4, for example of a polyethylene material, one such bolt also being arranged as a central or core element in the common sheath 5.

Figure 2:
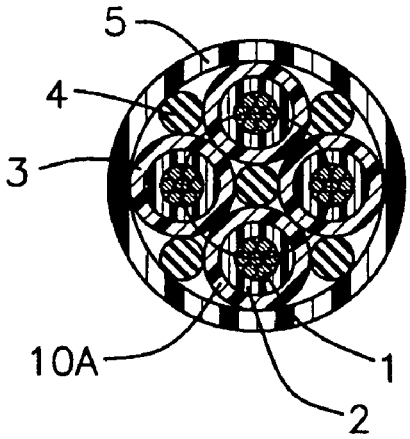

FIG. 2 shows one electric cable component or quad 1-5 of FIG. 1 in a normal or non-tensioned condition. The central axes of the four conductors 1 may here be considered to lie on a circle 10*a*, thus defining the geometrical relationships in this condition.

Figure 3:
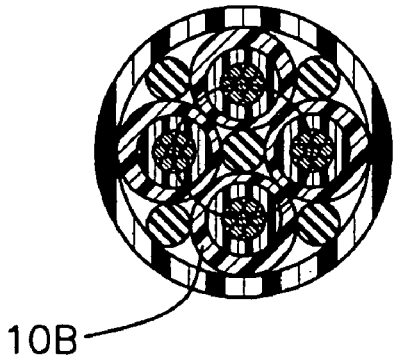
FIG. 3 shows the cable component according to FIG. 2 when exposed to axial tension and thus with a resulting change of geometrical relationships within the cable cross-section.

Under axial tension there will be radial deformation of the elastomer layer 3 around each insulated conductor 1, 2, as illustrated in FIG. 3. Thus, the elastomer layers 3 will deform so as to make possible inward displacement of the conductors 1, whereby the circle through a central axis of these conductors will have a reduced diameter as shown at 10*b* in FIG. 3. This deformation or geometrical change involves displacement of elastomer material in layer 3 from a radially inward portion thereof towards the radially outward portions thereof, as seen in relation to the centre or core of the cable quad.

In other words the pitch angle of the twisted conductors 1 will be reduced, this also being equivalent to an increase of the lay length of the twisted conductors. In this manner most of the cable elongation when subjected to tensional forces, will be accompanied by an elongation of the lay length and not by elongation of the copper material in the conductors 1. Instead of a cable quad as illustrated in FIGS. 1, 2 and 3 each electric cable component may comprise other numbers of conductors than four, for example two or three (pairs or triples). The insulating layer 2 may be of any common insulation material, and usually polyethylene.

The material properties are important in connection with the above. Whereas the insulating layer 2 comprises relatively hard materials, as are commonly used in insulation systems for electric cables, the elastomer material in layer 3 is more rubber-like and of substantially lower hardness. Examples of preferred materials for this purpose are Nitril rubber—hardness 40-95 IRHD (Shore 60-75)

Fluorsilicon rubber—hardness 30-80 IRHD (these two materials are clearly extrudable, which is important here)

Epichlorine rubber—hardness 60-80 IRHD and

Viton (Dupont trademark)*—hardness 60-90 IRHD

IRHD: International Rubber Hardness Degrees.

*) Viton is a fluoropolymer elastomer comprising—

Viton A: VF2/HFP (VF2=vinylidene fluoride, HFP=hexafluoropropylene)

Viton B: VF2/HFP/TFE (TFE=tetrafluoroethylene)

Viton F: VF2/HFP/TFE

Viton extreme: TFE/propylene and ethylene/TFE/PMVE (PMVE=perfluoromethylvinylether)

It is to be noted also that resistance to oil is desired, which is the case with fluorsilicon rubber for example.

Another feature of significance is the bonding of the elastomer layer 3 to the insulating layer 2, so as to avoid any relative lengthwise movement between these layers. Such bonding will easily be obtained during the extrusion process as referred to above.

As will be understood from the above the main idea or basic solution according to this invention is to extrude a layer 3 of an elastomer material outside the insulation system or layer 2 on electrical conductors 1 in electric cables where components or parts involved are twisted in the traditional manner. When the twisted copper conductor signal or power cable is exposed to tension and thereby is subjected to elongation, the soft and elastic layer 3 outside the insulating layer 2 is compressed. This compression of the elastomer material causes a reduced pitch angle of the copper conductors. Thus, most of the cable elongation will be in form of an increased twisting lay length and not by elongation of the copper material in the conductors. The insulation layer is not compressed to any significant degree and will maintain the necessary insulation properties. When the tensional forces are removed, the soft and elastic layer 3 will return back to its original shape (FIG. 2). As long as the elastomer layer 3 is soft and elastic, this tension cycle can be repeated a number of times.

The invention claimed is:

1. Electric cable comprising:

at least one conductor with an insulating layer applied thereto and being twisted around a longitudinal axis of the cable, wherein the insulated conductor is provided with an enclosing elastomer layer, bonded to the insulating layer, of a material having a hardness being substantially lower than the hardness of the insulating layer.

2. Electric cable according to claim 1, wherein the hardness of the material in the elastomer layer is within the range of 30-95 IRHD.

3. Electric cable according to claim 1, wherein the elastomer material is selected from the group consisting of epichlorine-hydrine rubber, fluoropolymer (Viton).

4. Electric cable according to claim 1, wherein the elastomer material is resistant to oil and petroleum jelly and vaseline.

5. Electric cable according to claim 1, wherein the elastomer material is selected from the group consisting of nitril rubber or fluorsilicon rubber.

* * * * *